US008592737B2

(12) United States Patent
Deschatre

(10) Patent No.: US 8,592,737 B2
(45) Date of Patent: Nov. 26, 2013

(54) DEVICE FOR SIMULTANEOUS DEPLOYMENT OF THE CONTROL SURFACES OF A PROJECTILE

(75) Inventor: Geoffroy Deschatre, Marmagne (FR)

(73) Assignee: Nexter Munitions, Versailles (FR)

( * ) Notice: Subject to any disclaimer, the term of this patent is extended or adjusted under 35 U.S.C. 154(b) by 263 days.

(21) Appl. No.: 13/008,454

(22) Filed: Jan. 18, 2011

(65) Prior Publication Data

US 2011/0180655 A1 Jul. 28, 2011

(30) Foreign Application Priority Data

Jan. 28, 2010 (FR) ..... 10 00344

(51) Int. Cl.
*F42B 10/14* (2006.01)

(52) U.S. Cl.
USPC ..... 244/3.28; 244/3.27

(58) Field of Classification Search
USPC ..... 244/3.24, 3.27–3.29, 46, 49; 475/207, 475/302; 74/665 GA, 665 N, 109, 120
IPC ..... F24B 15/01
See application file for complete search history.

(56) References Cited

U.S. PATENT DOCUMENTS

| | | | | |
|---|---|---|---|---|
| 4,600,167 | A * | 7/1986 | Kastenhuber et al. | 244/3.28 |
| 6,224,013 | B1 | 5/2001 | Chisolm | |
| 6,880,780 | B1 | 4/2005 | Perry et al. | |
| 7,851,734 | B1 * | 12/2010 | Hash et al. | 244/3.27 |
| 7,923,671 | B1 * | 4/2011 | Huguenin et al. | 244/3.24 |
| 2006/0071120 | A1 * | 4/2006 | Selin et al. | 244/3.27 |

FOREIGN PATENT DOCUMENTS

| | | |
|---|---|---|
| DE | 38 38 735 A1 | 5/1990 |
| EP | 1 548 392 A1 | 6/2005 |
| EP | 1328459 | 6/2005 |
| FR | EP 1 550 837 A1 | 7/2005 |
| GB | 759679 | 10/1956 |
| WO | WO 02/18867 A1 | 3/2002 |

OTHER PUBLICATIONS

Search Report issued in FR 1000344, dated Aug. 26, 2010. (with English-language translation).

* cited by examiner

*Primary Examiner* — Joseph W Sanderson
*Assistant Examiner* — Timothy Schwarz
(74) *Attorney, Agent, or Firm* — Oliff & Berridge, PLC

(57) ABSTRACT

A simultaneous deployment device for the control surfaces of a projectile for which each control surface is intended to be pivoted by a motor after its deployment to ensure the piloting, each control surface being held within the projectile and deployed towards the exterior of the projectile by the expansion of elastic means, each control surface being deployed by a rotation with respect to a control surface support and following a deployment axis that is crosswise to that of the projectile, wherein the elastic means are common means to ensure the deployment of all the control surfaces, the expansion of the elastic means generating a push stress directed along the axis of the projectile and being exerted on a push plate which transmits the push stress to as many slides as there are control surfaces to be deployed, each slide cooperating without slipping with a matching profile integral with a base of the control surface to make this pivot with respect to its support and first releasable locking means that maintain the elastic means in the compressed position.

12 Claims, 9 Drawing Sheets

DEVICE FOR SIMULTANEOUS DEPLOYMENT OF THE CONTROL SURFACES OF A PROJECTILE

BACKGROUND OF THE INVENTION

1. Field of the Invention

The technical scope of the invention is that of deployment devices for the control surfaces of projectiles.

2. Disclosure of the Related Art

So as to ensure the greatest possible accuracy of modern ballistic or propelled projectiles, these are equipped with control surfaces to correct their trajectory or to stabilize them. These control surfaces are piloted by electric motors. Given the space taken up by these control surfaces, these are generally contained within the projectile body during the handling phase and when being put in place in a gun barrel as well as during the interior ballistics phase. The control surfaces are then deployed in flight.

Patent EP-1550837 proposes to deploy the control surfaces by using springs individually equipping each control surface. This device suffers a major drawback. So as not to comprise the stability of the projectile, it is essential for the deployment of all the control surfaces to be simultaneous, this device, however, cannot guarantee this since the springs act independently of one another. Because of this, any differences in the elasticity or of any other mechanical characteristic of the springs risks causing the control surfaces to deploy at slightly different times from one another.

Patent FR-1328459 discloses a device to simultaneously deploy the tail fins of a rocket. The fins are deployed by means of toothed sectors integral with the control surfaces and meshing with a toothed-rack ring. A single toothed-rack ring ensures the simultaneous deployment of the fins.

Similarly, patent DE-3838735 discloses a device to simultaneously deploy fins. As in FR1328459, this device requires a single sliding element incorporating toothing around its periphery and meshing with pinions at the base of the control surfaces.

The drawback to these solutions lies in that the toothed ring prevents the fin from pivoting after its deployment. These solutions are thus unsuitable for the deployment of control surfaces intended to be pivoted by a motor after their deployment to ensure the piloting of the projectile.

U.S. Pat. No. 6,880,780 discloses a device to deploy control surfaces by means of lever arms also acting as locking means for the control surfaces in their retracted position. Such a device is however particularly cumbersome axially and is difficult to integrate into a projectile. It is reserved for large-sized projectiles, such as missiles.

SUMMARY OF THE INVENTION

The invention proposes to supply a solution to ensure the simultaneous deployment of all the control surfaces. For this, the energy required for the deployment is supplied by a single spring which makes racks slide simultaneously enabling the simultaneous deployment of the control surfaces whilst enabling them, once deployed, to be able to pivot around their axes driven by a motor, to ensure the piloting of the projectile.

The invention thus relates to a device to deploy the control surfaces of a projectile for which each control surface is intended to be pivoted by a motor after its deployment to ensure the piloting, each control surface being held within the projectile and deployed outwards by the expansion of elastic means, each control surface being deployed by a rotation with respect to a control surface support and following a deployment axis that is crosswise to that of the projectile. This control surface deployment device is characterized in that the elastic means are common means to ensure the deployment of all the control surfaces, the expansion of the elastic means generating a push stress directed along the projectile's axis and being exerted on a push plate which transmits the push stress to as many slides as there are control surfaces to be deployed, each slide cooperating without slipping with a matching profile integral with a base of the control surface to make this pivot with respect to its support and first releasable locking means that maintain the elastic means in the compressed position.

According to a first embodiment, the device is namely characterized in that the first locking means are constituted by a substantially cylindrical ferrule that separates the push plate of the slides when the elastic means are being compressed, the ferrule incorporating lugs abutting radial arms carried by the push plate, since the ferrule is able to pivot following the projectile's axis to release the push plate and cause the expansion of the elastic means, the radial arms thereafter push the slides.

According to another characteristic, the device incorporates second releasable locking means that hold the control surfaces in their retracted position.

According to another characteristic, the device incorporates third locking means holding the control surfaces in their deployed position.

According to another characteristic, the ferrule incorporates internal toothing cooperating with a second pinion driven by a motor to enable the ferrule to pivot and unlock the elastic means.

According to another characteristic, the second locking means comprise fingers integral with the ferrule, each finger engaging in a longitudinal groove of the slide, the fingers disengaging from their grooves when the ferrule pivots.

According to another characteristic, the third locking means are constituted for each control surface by at least one ball push bearing engaging in a recess in the slide when the control surfaces are deployed.

According to another characteristic, the slide is a rack that cooperates with a matching profile formed by a first toothed pinion integral with the base of the control surface.

According to another embodiment, the push plate, which is mounting sliding along an axis coaxial to the projectile, may incorporate a tooth to ensure its guidance on this axis, such tooth moving in a longitudinal groove ending in a helicoidal portion, the push plate thereby partially pivoting around the axis at the end of its axial displacement such that each arm is moved away from the slide it has pushed.

BRIEF DESCRIPTION OF THE DRAWINGS

The invention will become more apparent from the following description, such description made in reference to the appended drawings, in which.

DETAILED DESCRIPTION OF PREFERRED EMBODIMENTS

Figure 1:
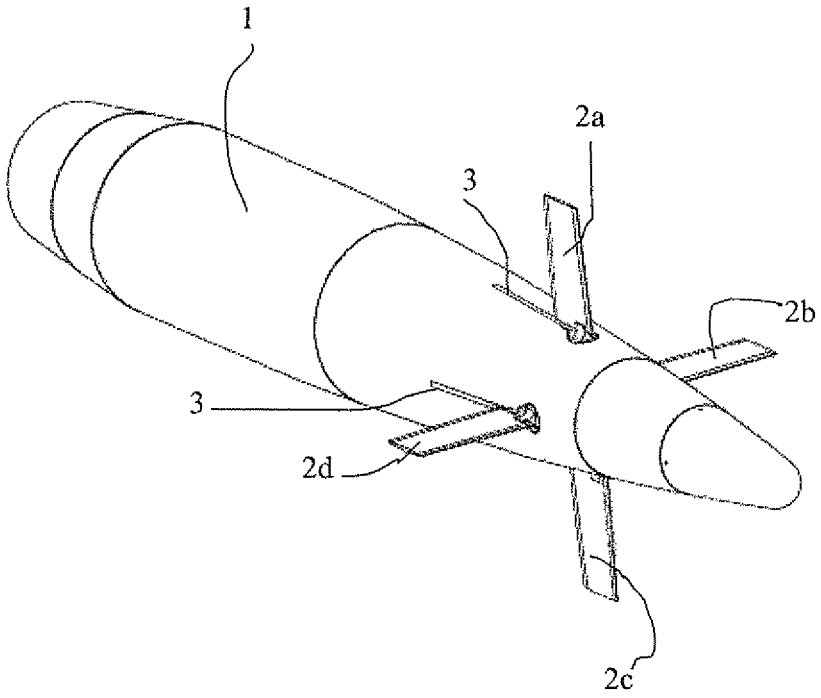
FIG. 1 is a global view of the device mounted on a projectile with its control surfaces deployed.

According to FIG. 1, a projectile 1 is equipped with control surfaces 2*a*, 2*b*, 2*c* and 2*d* shown deployed and arranged at a front part of the projectile 1. To the rear and in the alignment of the plane of control surfaces 2*a* to 2*d* are slots 3 in the projectile, only two of which are shown.

The device to deploy the control surfaces 4 is contained in the front part of the projectile 1 and is thus not visible in the drawing in its entirety. In their retracted position, control surfaces 2*a* to 2*d* are inserted into the slots 3 (configuration not shown in the Figure).

Figure 2:
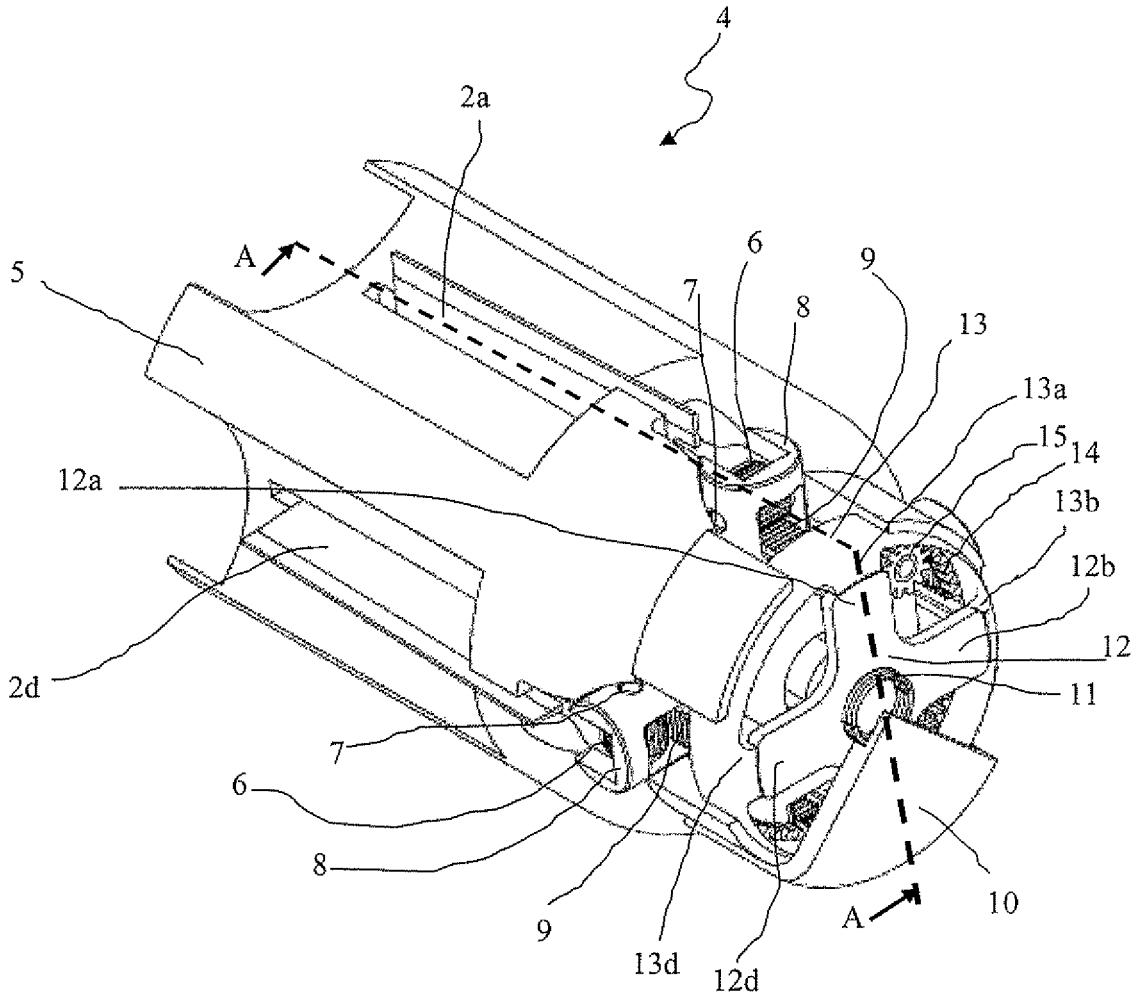
FIG. 2 is a three-quarter view of the device with the control surfaces retracted.

According to FIG. 2, the deployment device incorporates a body 5 that houses the control surfaces 2*a* to 2*d* in their retracted position (only two control surfaces are visible in FIG. 2). The base of each control surface 2*a* to 2*d* incorporates a toothing forming a pinion 6. A pin 7 integral with a support 8 passes through the base forming a pinion 6.

After the deployment of control surfaces 2*a* to 2*d*, each support 8 is intended to be pivoted following an axis perpendicular to the projectile's axis to enable it to be piloted. This pivoting is ensured by a motor (not shown). The pinion 6 meshes with a toothed slide (also called rack 9) that slides in a groove in the body 5.

In its foremost part, the deployment device 4 incorporates a cowling 10 (only one sector of which is shown) integral with the body 5. This cowling 10 incorporates a housing at its centre that accommodates the end of compressed elastic means which are here formed of a spring 11 with helicoidal coils. A first end of the spring 11 presses on a cross-shaped push plate 12, which incorporates radial arms (as many arms as racks 9).

The arms of the push plate each press on a lug 13*a* to 13*d* integral with a ferrule 13 (lug 13*c* cannot be seen in FIG. 2 as it is hidden by a portion of the cowling 10). The ferrule 13 is more particularly visible in FIG. 8. It is substantially cylindrical and incorporates a crown with inner toothing 14 on its internal periphery. This toothed crown 14 meshes with a pinion 15 driven by a motor (not shown). Lugs 13*a*, 13*b*, 13*c* and 13*d* are made in the form of flat tongues extending radially towards the inside of the ferrule 13 and which are evenly spaced angularly.

In the configuration shown in FIG. 2, the control surfaces 2*a* to 2*d* are folded and lugs 13*a* to 13*d* of the ferrule 13 separated the racks 9 from the arms of the push plate 12. In this way, the racks 9 are not subjected to the load generated by the spring 11 thereby preventing the control surfaces 2*a* to 2*d* from deploying. The ferrule 13, which opposes the cross-shaped push plate 12, thus forms first locking means to ensure that the elastic means 11 are held in the compressed position.

Figure 3:
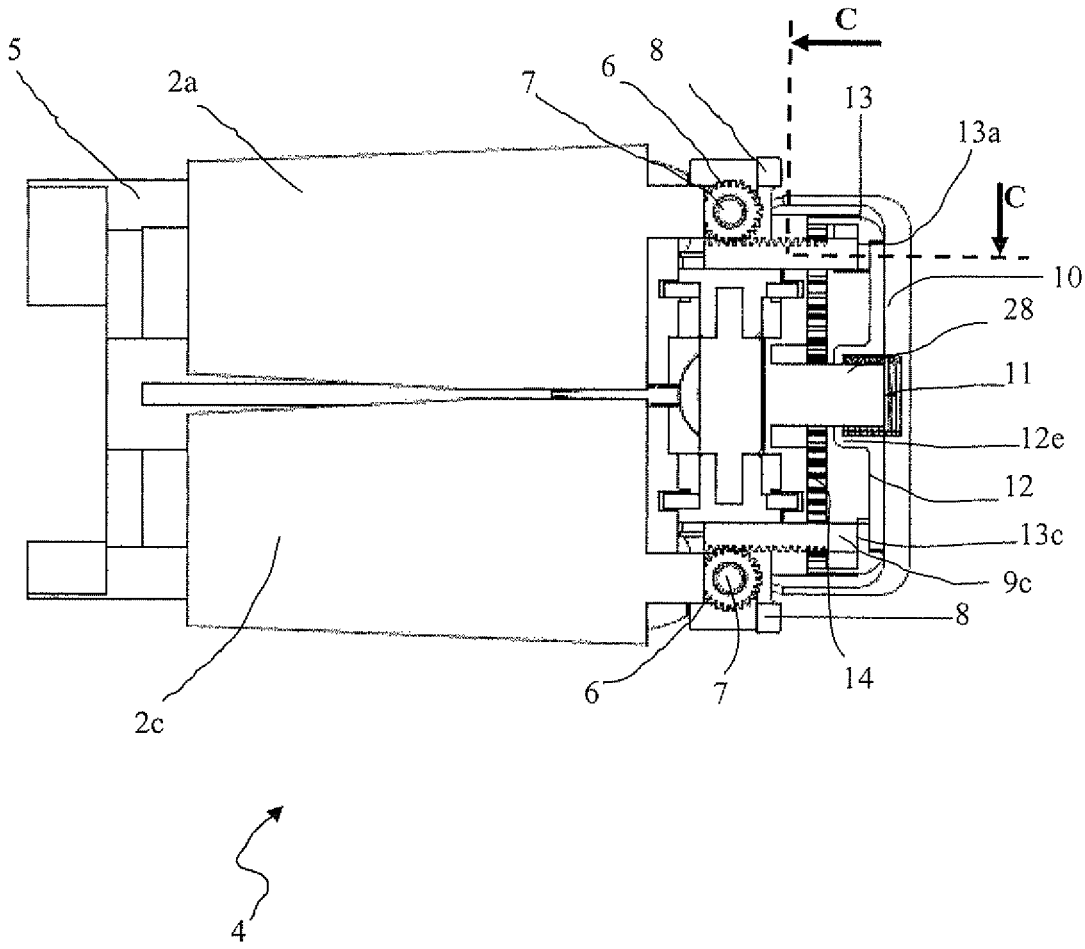
FIG. 3 is a longitudinal section view along a section plane A, shown in FIG. 2, with the control surfaces in their retracted position.

FIG. 3 shows a longitudinal section of the device 4 with the control surfaces 2*a* and 2*c* folded. Lugs 13*a* and 13*c* of the ferrule 13 separating racks 9*a* and 9*c* from arms 12*a* and 12*c* of the push plate 12 can be seen in particular. Note the position of the spring 11 which lies coaxially to the deployment device 4 and is wound round a pin 28 integral with the body 5. The second end of the spring presses on the push plate 12 at the bottom of a housing 12*e* centered on the pin 28.

Figure 4:
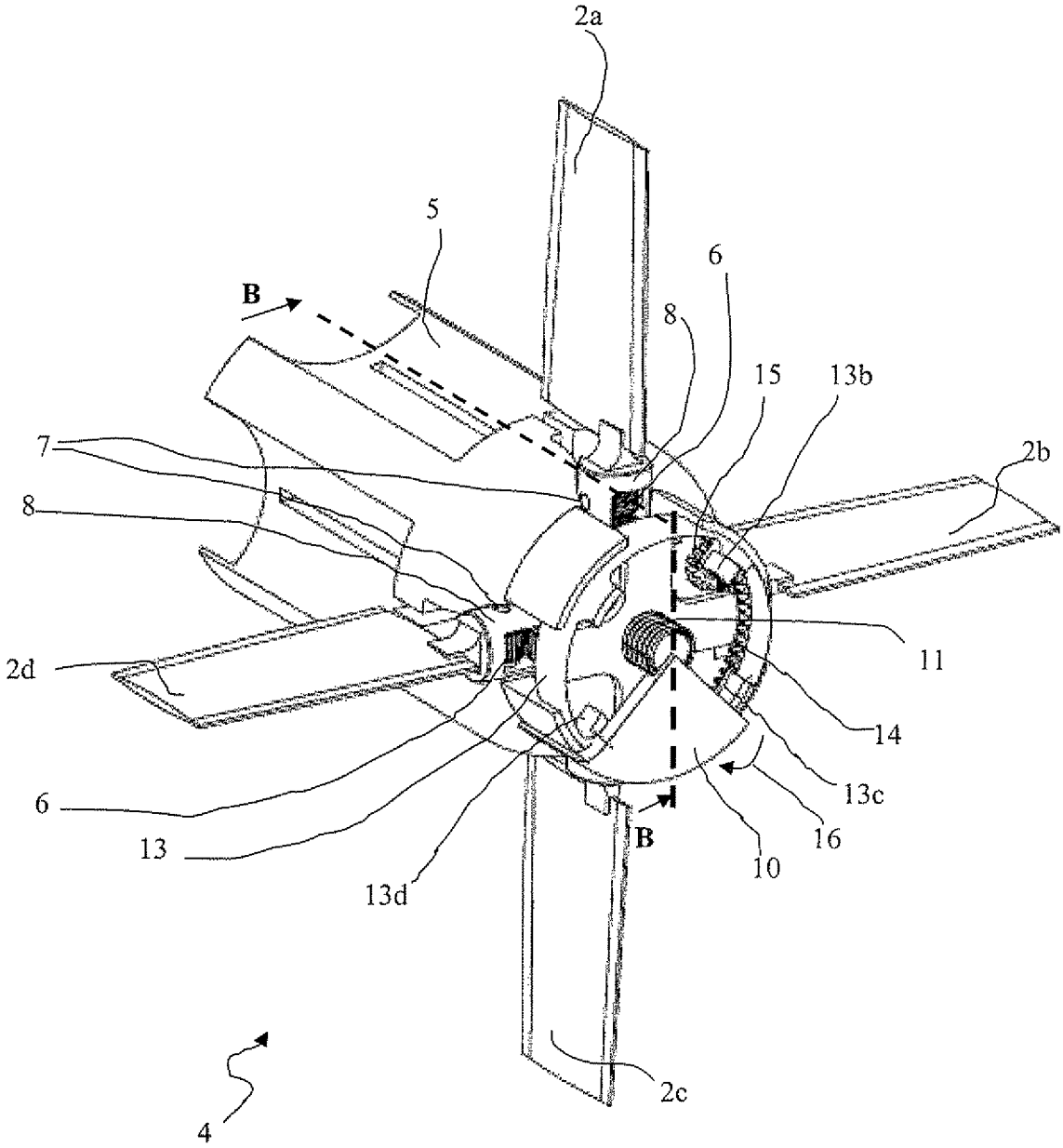
FIG. 4 shows a three-quarter view of the device with its control surfaces deployed.

FIG. 4 shows the control surfaces 2*a* to 2*d* deployed and out of the body 5. The ferrule 13 has made a quarter turn in direction 16 with respect to the position it occupies in FIGS. 2 and 3. The spring 11 has been released and pushes the push plate 12 against the racks 9. Each arm of the plate 12 pushes a rack 9.

To make the control surfaces deploy from the state shown in FIGS. 2 and 3, the pinion has had to rotate (such rotation being driven by a motor, not shown) thereby making the ferrule 13 take a quarter turn via the crown with inner toothing 14. Once this rotation has been performed, lugs 13*a* to 13*d* no longer hold the cross-shaped push plate and this is now able to transmit the load from the spring 11 to the racks 9 (not visible in this FIG. 4). Thereafter, the racks 9 drive the control surfaces 2*a* to 2*d* in rotation around pins 7 via the pinions 6.

Figure 5:
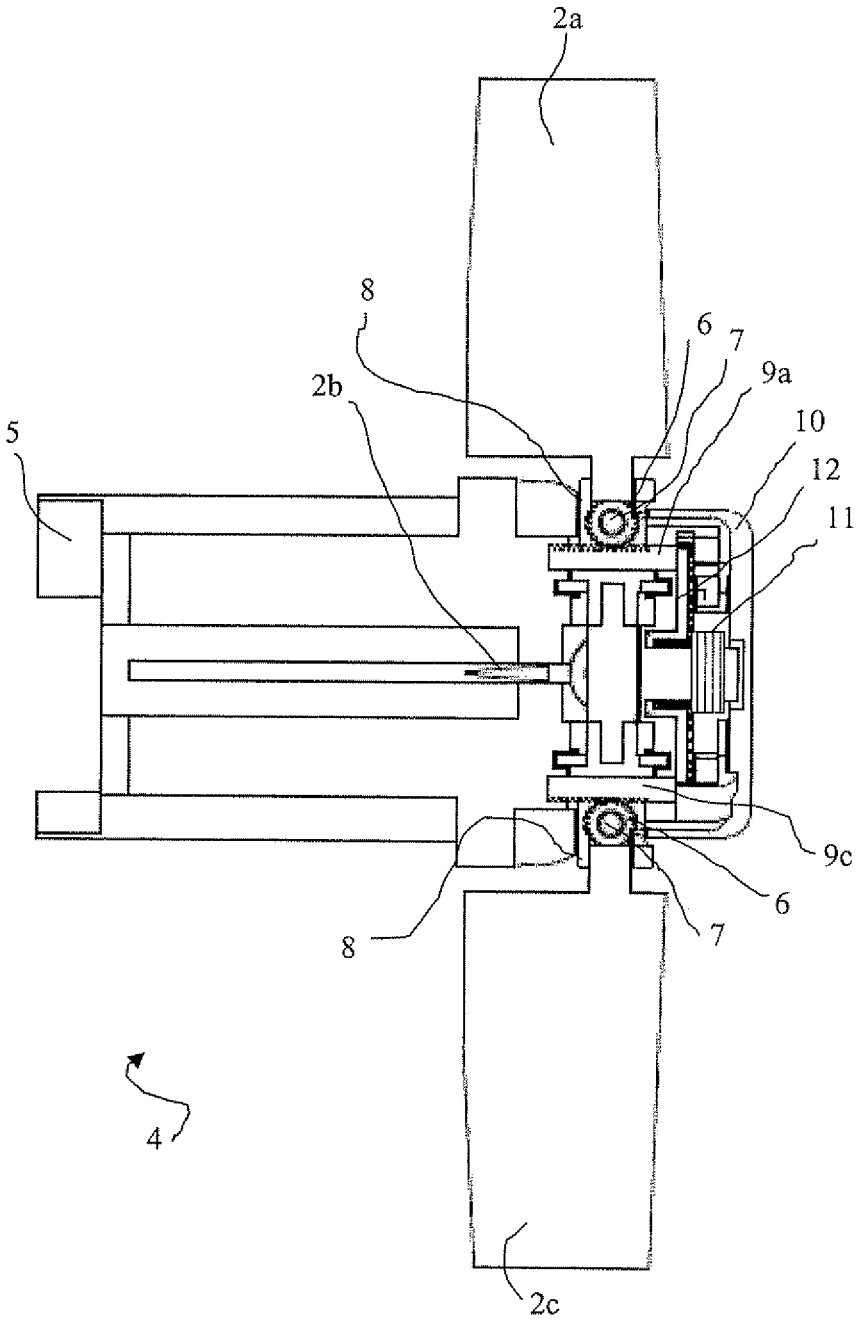
FIG. 5 shows a longitudinal section view along a section plane B, shown in FIG. 4, with the control surfaces in their deployed position.

FIG. 5 shows a longitudinal section of the device 4 and the elements as mentioned previously with the exception of the pinion 15 and crown with inner toothing 14, which are hidden by the cross-shaped push plate 12. Note the change in position of the control surfaces 2*a* to 2*d* that are deployed, the position of racks 9*a* to 9*d*, the push plate 12 and in particular the contact between the push plate 12 and the corresponding surface of each rack 9.

Racks 9*a* to 9*d* have been pushed by the plate 12 causing them to penetrate more deeply into each of the supports 8 of the control surfaces. In their final pushed-in position, the racks 9*a* to 9*d* penetrate more deeply into the control surface supports 8 passing right through them.

At the end of their translational motion, the racks 9*a* to 9*d* are no longer in contact with the plate 12 (the gap between plate and rack no being visible in the drawing). In this way, each of the racks 9*a* to 9*d* is able to independently follow the movements of the control surface supports piloted by the motors (not shown).

Figure 6:
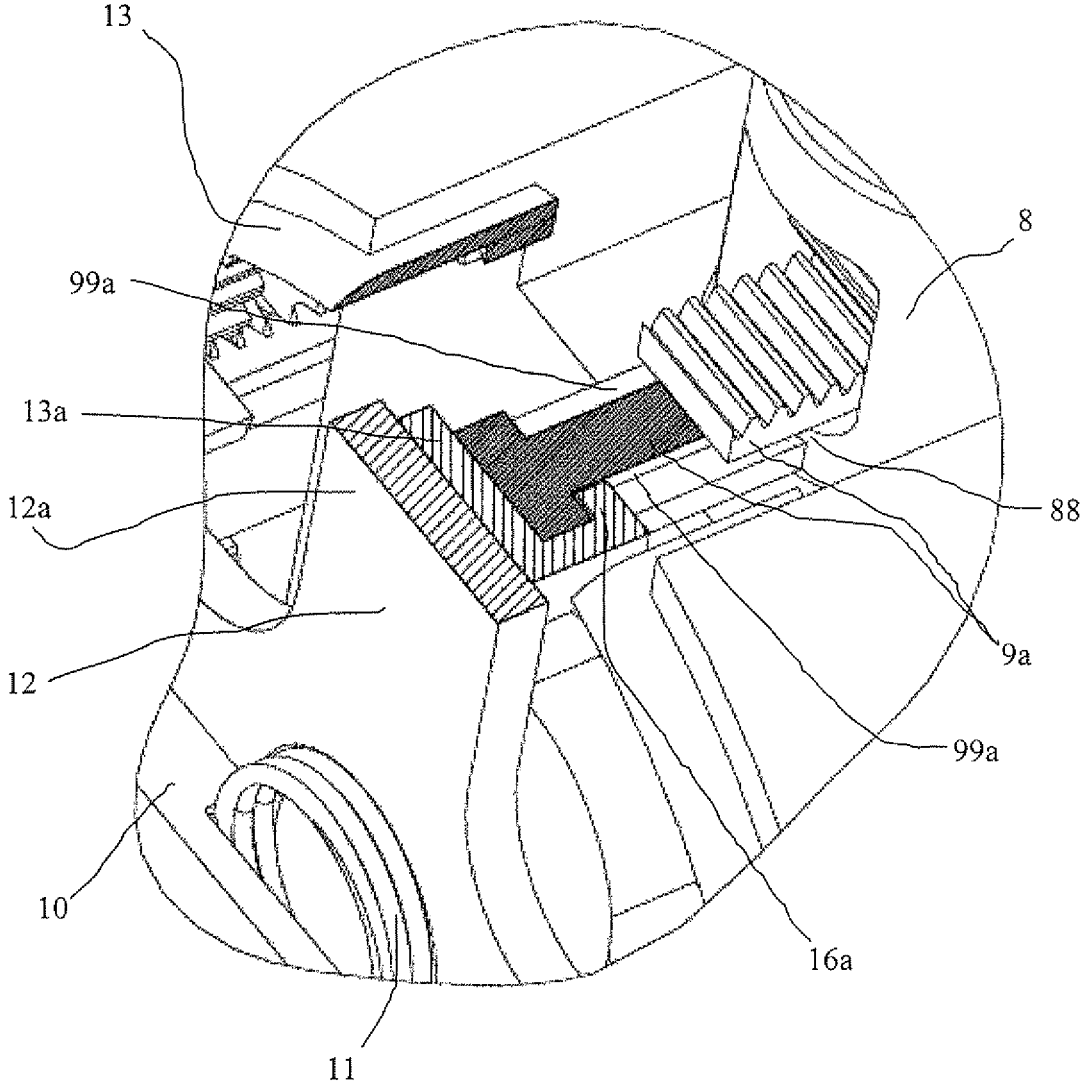
FIG. 6 shows a detailed partial section view with orthogonal planes C, shown in FIG. 3, of the locking means of the device with the control surfaces in their retracted position.

FIG. 6 shows a detailed view of a partial section made along the orthogonal planes C shown in FIG. 3 of the device in its configuration with the control surfaces 2*a* to 2*d* retracted. The ferrule 13 separates the push plate 12 from the rack 9*a*. The rack 9*a* has a longitudinal groove 99*a* on each of its lateral faces (symmetrical with respect to the rack's toothing).

The rack has thus two grooves 99*a*. One of these grooves 99*a* can be more clearly seen in FIG. 7 where we can see that the grooves 99*a* only open out at one end of the rack 9 and that they are used to guide the translational motion of the rack 9*a* in the support 8, which, to this end, incorporates two tongues 88 engaged in the grooves 99*a* (one of such tongues 88 can be more clearly seen in FIG. 6).

Figure 8:
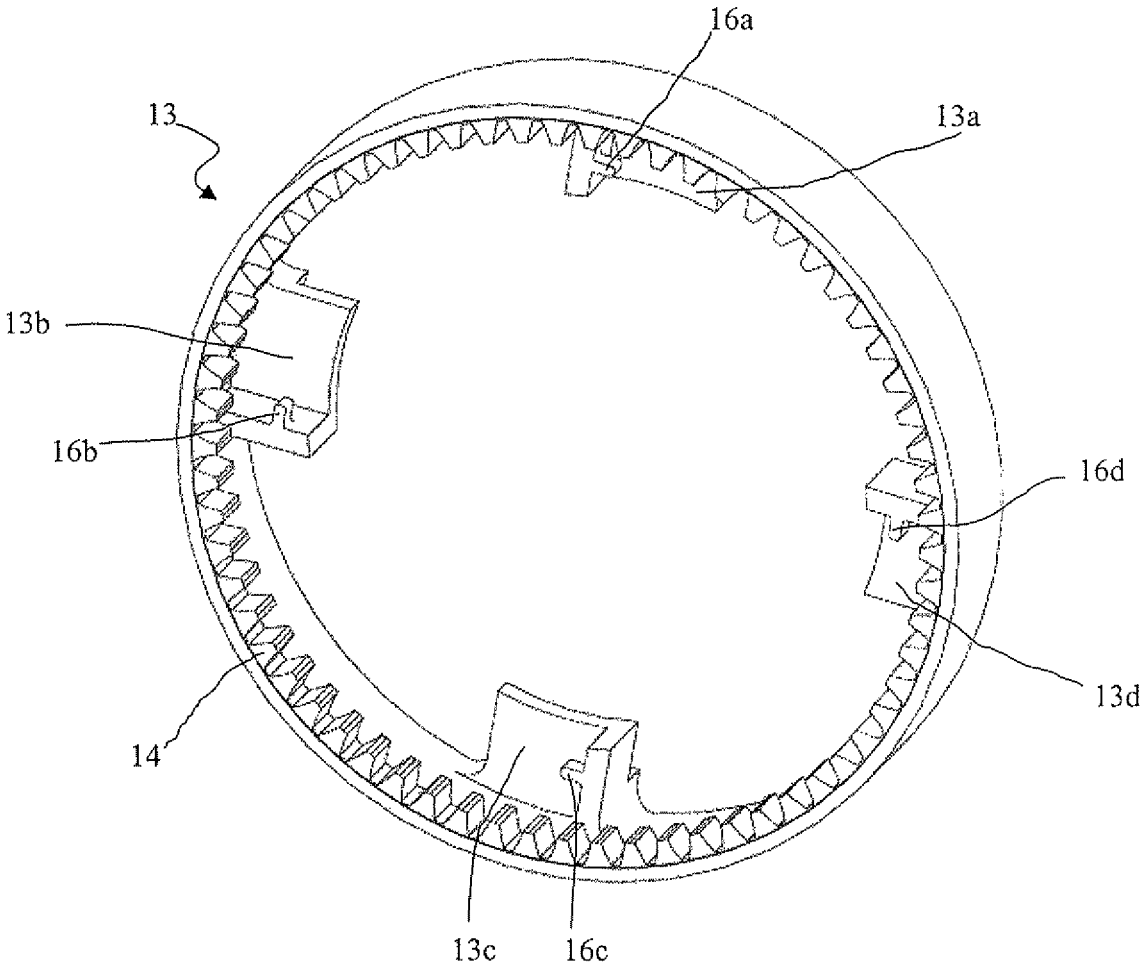
FIG. 8 shows a three-quarter view of the ferrule alone.

With reference once again to FIG. 6, the ferrule 13 incorporates a locking finger 16*a* on its lug 13*a*, which is positioned on the face directed towards the rack 9*a* (the configuration of the ferrule 13 alone can be more clearly seen in FIG. 8 which gives a view of the ferrule oriented towards the racks 9).

The finger 16*a* is engaged in a single groove 99*a* of the rack 9*a*, to the end of the rack 9*a* where this groove 99*a* does not open out. In this way, the finger 16*a* blocks the sliding of the rack 9*a* thereby also locking (by means of the pinion 6) the control surface 2*a* in its folded position in the body 5.

The section shown in FIG. 6 more particularly shows rack 9*a*, but all the racks are structurally identical and the ferrule 13 also incorporates identical locking fingers 16 arranged at each rack and engaged in a groove of the rack in question. Each locking finger 16*a* to 16*d* is integral with a lug 13*a* to 13*d* of the ferrule 13 (see FIG. 8).

Figure 7:
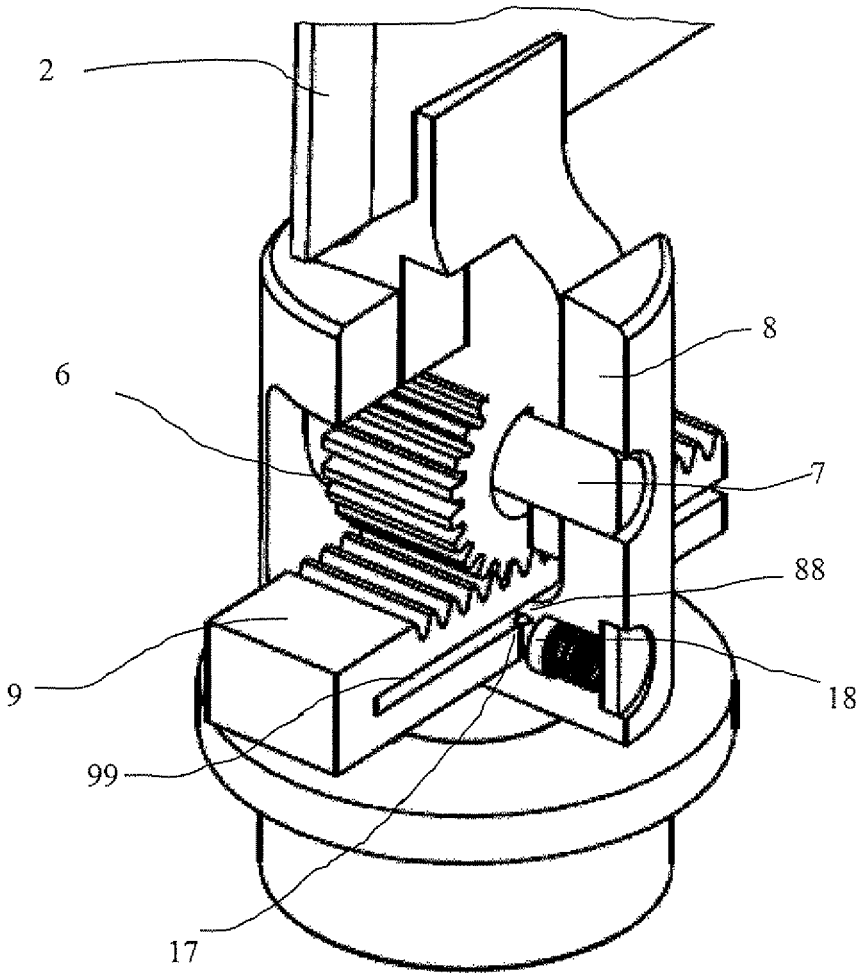
FIG. 7 is a partial view of the different elements of the device in the deployed position.

According to the detailed view shown in FIG. 7, which is valid for all the control surfaces, each rack 9 incorporates a housing 17 and each control surface support 8 incorporates a ball push bearing 18. A housing 17 is made in the rack 9 in a position such that when the control surface 2 is deployed, the ball push bearing 18 engages in the housing thereby forming a lock. It thereby immobilizes the rack in translation with respect to its support 8, also locking the control surface in its deployed position by means of the pinion 6.

Figure 9:
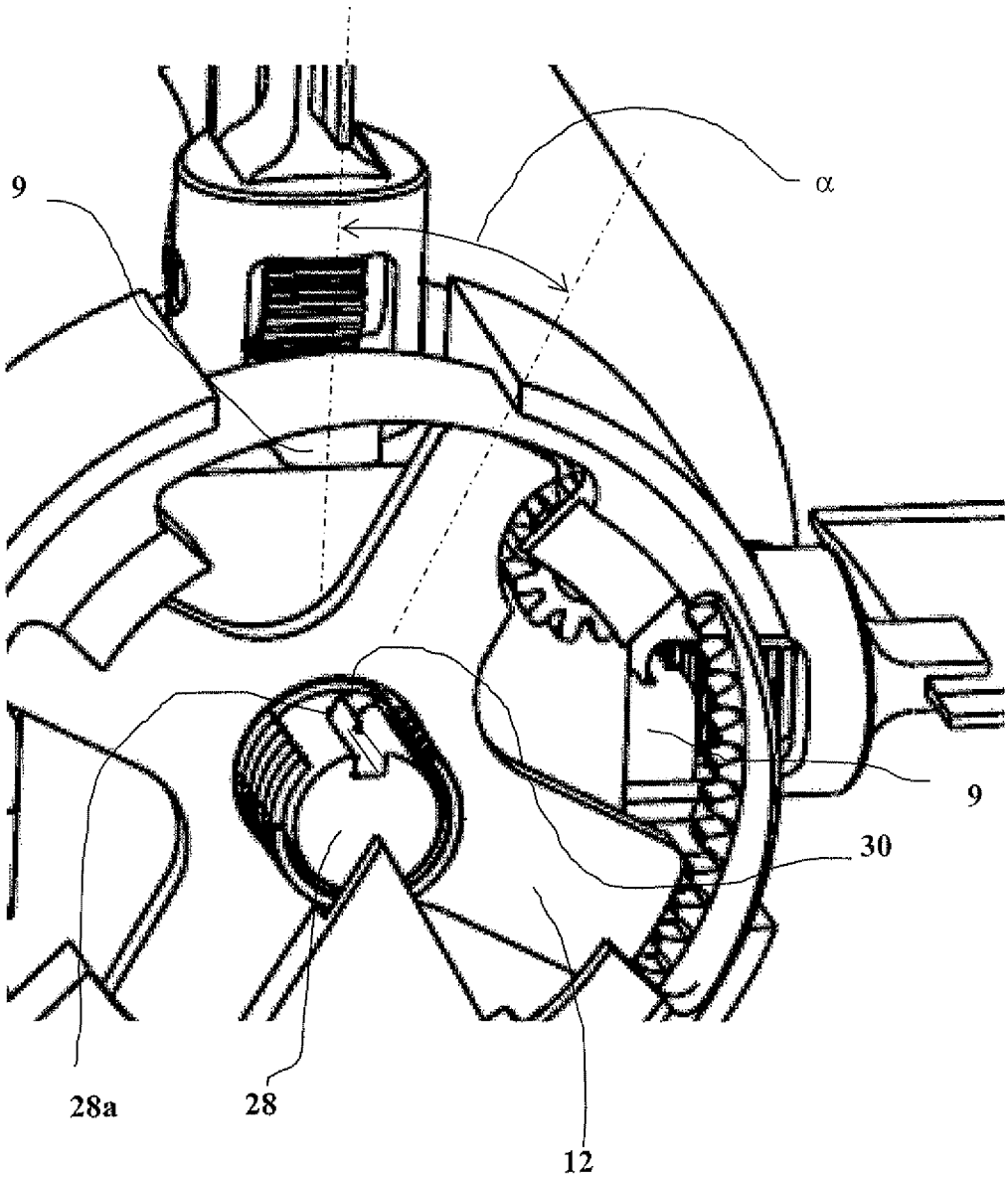
FIG. 9 is a three-quarter frontal torn away view showing another embodiment of the device.

FIG. 9 partially shows another embodiment of the invention.

This embodiment differs from the previous one in that the push plate may, after its axial displacement, partially pivot around the axis 28 on which it is mounted (axis coaxial to that of the projectile). Such pivoting enables each arm 12*a* to 12*d* of the push plate to be moved away from the slide 9 having been push by the arm.

Such an arrangement enables any interference or excessive friction between the racks 9 and the push plate 12 to be avoided during the subsequent pivoting of the control surfaces 2*a* to 2*d* carrying the racks.

For this, the axis 28 incorporates a guiding groove 28*a* that incorporates a straight part ending, at the end closest to the racks 9, by a helicoidal portion. A tooth 30 integral with the push plate 12 moves in this groove 28*a*. The pitch of the helicoidal part of the guiding groove 28*a* will be selected so as to make the push plate 12 pivots by an angle such that after the rotation each of the arms of the push plate 12 is no longer positioned in front of the slides 9. However, the slides 9 have reached the end of their stroke.

According to the embodiment shown in FIG. 9, the angle of rotation $\alpha$ of the push plate 12 is of around one eighth of a turn.

What is claimed is:

1. A device for simultaneous deployment of control surfaces of a projectile, each control surface configured to be pivoted by a motor after deployment of the control surface to ensure piloting, wherein each control surface is held within the projectile, and a first releasable locking element maintains an elastic element in a compressed position, each control surface is deployed towards an exterior of the projectile by expansion of the elastic element, each control surface being deployed by a rotation of each control surface with respect to a control surface support around a deployment axis that is crosswise to a lengthwise axis of the projectile, the lengthwise axis of the projectile including an anterior and a posterior of the projectile, the elastic element interacts with all of the control surfaces to ensure the deployment of all of the control surfaces in relation with slides, the expansion of the elastic element generating a push stress directed along the lengthwise axis of the projectile and exerted on a push plate which transmits the push stress to the slides and to the control surfaces to be deployed, and each of the slides engages, without slipping, with a matching profile integral with a base of the control surface, each of the slides making each respective control surface pivot with respect to the control surface support, the matching profile integral with the base of the control surface being housed within the control surface support.

2. The device for simultaneous deployment of the control surfaces of a projectile according to claim 1, wherein the first locking element is constituted by a ferrule, which is substantially cylindrical, that separates the push plate from the slides when the elastic element is being compressed, the ferrule incorporates lugs abutting radial arms of the push plate, and the ferrule is able to pivot around the lengthwise axis of the projectile to release the push plate and cause the expansion of the elastic element, so that the radial arms thereafter push the slides.

3. The device for simultaneous deployment of the control surfaces of a projectile according to claim 2, wherein the device incorporates a second releasable locking element holding the control surfaces in a retracted position.

4. The device for simultaneous deployment of the control surfaces of a projectile according to claim 3, wherein the second releasable locking element comprises fingers integral with the ferrule, each of the fingers engaging in a longitudinal groove of each of the slides, the fingers disengaging from the grooves when the ferrule pivots.

5. The device for simultaneous deployment of the control surfaces of a projectile according to claim 2, wherein the ferrule incorporates internal toothing engaging with a second pinion driven by a motor to enable the ferrule to pivot and unlock the elastic element.

6. The device for simultaneous deployment of the control surfaces of a projectile according to claim 2, wherein the push plate, which is mounted slideably along an axis coaxial to the lengthwise axis of the projectile, incorporates a tooth to ensure guidance of the push plate on the axis, the tooth moves in a longitudinal groove ending in a helicoidal portion, and the push plate thereby partially pivots around the axis at an end of an axial displacement of the push plate such that each of the radial arms is moved away from each of the slides which the radial arms pushed.

7. The device for simultaneous deployment of the control surfaces of a projectile according to claim 1, wherein the device incorporates a third locking element holding the control surfaces in a deployed position.

8. The device for simultaneous deployment of the control surfaces of a projectile according to claim 4, wherein the third locking element is constituted by at least one ball push bearing engaging in a recess in each of the slides when the control surfaces are deployed.

9. The device for simultaneous deployment of the control surfaces of a projectile according to claim 1, wherein each of the slides is a rack that engages with a matching profile formed by a first toothed pinion integral with the base of the control surface.

10. The device for simultaneous deployment of the control surfaces of a projectile according to claim 1, wherein a gap exists between each of the slides and the push plate after deployment of each of the control surfaces.

11. The device for simultaneous deployment of the control surfaces of a projectile according to claim 1, wherein each control surface support is configured to pivot to control the pivoting of each of the control surfaces after deployment of each of the control surfaces, respectively.

12. The device for simultaneous deployment of the control surfaces of a projectile according to claim 11, wherein a gap exists between each of the slides and the push plate after deployment of each of the control surfaces, and each of the slides freely pivots in accordance with the pivoting of each control surface support after deployment of each of the control surfaces.

* * * * *